United States Patent [19]

Shields

[11] Patent Number: 4,637,301

[45] Date of Patent: Jan. 20, 1987

[54] CONTAMINATION CONTROL WORK STATION

[75] Inventor: William Shields, Los Alamos, N. Mex.

[73] Assignee: Environmental Air Control, Inc., Hagerstown, Md.

[21] Appl. No.: 577,413

[22] Filed: Feb. 6, 1984

[51] Int. Cl.[4] ..... B05B 15/12

[52] U.S. Cl. ..... 98/115.3

[58] Field of Search ..... 98/33 R, 33 A, 115 R, 98/115 LH; 55/DIG. 18, DIG. 29

[56] References Cited

U.S. PATENT DOCUMENTS

| | | | |
|---|---|---|---|
| 1,934,808 | 11/1933 | Liptay | 98/115 LH |
| 3,011,425 | 12/1961 | Grushoff | 98/115 LH |
| 3,273,323 | 9/1966 | Whitfield | 55/385 |
| 3,340,788 | 9/1967 | Landingham | 98/115 LH |
| 3,811,250 | 5/1974 | Fowler, Jr. | 98/115 LH X |
| 3,874,754 | 4/1975 | Saunders et al. | 98/41 R X |
| 3,895,570 | 7/1975 | Eagleson, Jr. | 98/115 LH |
| 3,897,721 | 8/1975 | Fuhst | 98/115 R |
| 4,249,463 | 2/1981 | Hornby | 98/115 LH |

FOREIGN PATENT DOCUMENTS

| | | | |
|---|---|---|---|
| 6120 | 1/1980 | European Pat. Off. | 98/115 SB |

OTHER PUBLICATIONS

Brochure: "To an Already Strong Product Group EACI Adds the 'W-Line'", EACI, Environmental Air Control, Inc., Hagerstown, MD.

*Primary Examiner*—Harold Joyce

*Attorney, Agent, or Firm*—Dowell & Dowell

[57] ABSTRACT

A work station for use when working with radioactive and other toxic or hazardous materials having an enclosed centralized work area which is normally open to the surrounding space in order to permit worker access, and in which a positive airflow is created into and within the work station to prevent the release of contaminated and toxic gases and particles through the access opening.

5 Claims, 5 Drawing Figures

CONTAMINATION CONTROL WORK STATION

BACKGROUND OF THE INVENTION

History of the Prior Art

When working with various toxic and hazardous materials including radioactive samples and strong mineral acids in laboratory conditions, it is essential that care be taken to insure that such materials are safely contained so that technicians working with these materials are protected from direct exposure to the materials or any toxic vapors or airborne particles generated by the handling of said materials. When working with relatively small to moderate samples of radioactive chemicals, it has been the practice to provide a work area which is generally isolated from the surrounding environment.

The containment or isolation of hazardous and toxic laboratory chemicals is generally accomplished by providing a work area which is enclosed or covered with a hood with access to the work area being permitted only by means of small openings which allow a chemist or laboratory technician to extend their arms into the work area. As the openings into such work stations also provide an avenue by way of which hazardous materials and fumes could escape or be vented to the surrounding area, it has been the practice in the industry to provide a positive airflow through the opening and into the work area. By creating a continuous ingress of air into the covered work area, airborne contaminants are prevented from escaping therefrom.

In addition to protecting workers from the potential release of toxic substances into the ambient air, it is a secondary consideration to also protect the laboratory samples from being contaminated by particulate matter in the incoming ambient air and the air within the work station. In some prior art structures, the air within the work station is passed through filter elements before being introduced into the work area.

There are other considerations, however, which have not been adequately provided for by the work station apparatuses of the prior art. One such consideration is associated with the operation of the work station when either the ambient air supply or exhaust from the work station are interrupted. If the ambient air supply is terminated, there is no positive airflow through the access opening into the work area. Under such conditions, airborne contaminants or fumes from within the work area may escape to the surrounding environment. Likewise, if the exhaust from the work area is terminated, then it is possible that contaminates and fumes could be forced outwardly through the access opening by the air circulation means within the work station.

In addition to the foregoing, it is also necessary to provide means for removing or disposing of solids or other waste or contaminated products and articles, such as empty supply containers, tubes, tools, gloves, and the like. If such items were to be withdrawn from the controlled enclosure or work station, toxic or hazardous materials would be released to the ambient environment.

Further, if an accident or spill should occur within the work area of a controlled environment enclosure, portions of the physical structure of the work area could be severely contaminated and/or destroyed. With prior art structures, those portions of the enclosure which are most directly affected by the materials being used therein cannot be easily removed or replaced without requiring the entire work station to be dismantled.

Some examples of prior art structures for controlled work stations are disclosed in U.S. Pat. No. 3,373,323 to Whitfield; U.S. Pat. No. 3,340,788 to Landingham et al.; U.S. Pat. No. 3,811,250 to Fowler, Jr.; U.S. Pat. No. 3,895,570 to Eagleson, Jr.; U.S. Pat. No. 3,897,721 to Fuhst; and U.S. Pat. No. 4,249,463 to Hornby.

SUMMARY OF THE INVENTION

This invention is directed to a contamination control unit or work station having an outer housing providing an access opening into a chamber defined by a removable work enclosure. The work station includes a blower unit for drawing ambient air through the access opening and along an ambient air inlet which extends to the upper portion of the housing. The ambient air is directed downwardly by the blower unit through a HEPA filter and into the work area. Air passing through the work area is vented through the floor of the work area to a primary exhaust system. A disposal chute is provided within the access opening in order to permit the disposal of materials within the controlled air circulation environment of the work station. Separate storage compartments are also provided along the sides of the work area.

It is the primary object of this invention to provide a contaminaton control unit having a Class 100 airflow curtain established between the work area within the unit and the surrounding room to prevent the release of any toxic or contaminated particles or fumes from the work area and into the ambient air surrounding the unit.

It is another object of the present invention to provide a laboratory enclosure having a controlled airflow wherein the release of toxic fumes or other airborne particles is prevented even if either of the system's ambient air supply or exhaust should malfunction or fail.

It is yet another object of the present invention to provide an air circulation hood for use in a controlled environment work station in which ambient air drawn into the system is filtered through a HEPA filter structure prior to being introduced into the work area.

It is also an object of this invention to provide a work station for use with hazardous or toxic substances in which the actual work enclosure may be easily removed from the work station housing for cleaning or replacement in the event such enclosure becomes contaminated.

It is a further object of this invention to provide a controlled airflow environment for working with hazardous substances wherein chute means are provided within the enclosure for disposing of contaminated materials within the controlled environment so that no contaminants are exposed to the ambient environment.

It is the further object of the invention to provide a work station having an airflow environment in which the actual working surface is surrounded by a laminar clean airflow and wherein storage means are provided for housing materials in spaced and separated relationship from the working area.

DESCRIPTION OF THE PREFERRED EMBODIMENT

Figure 1:
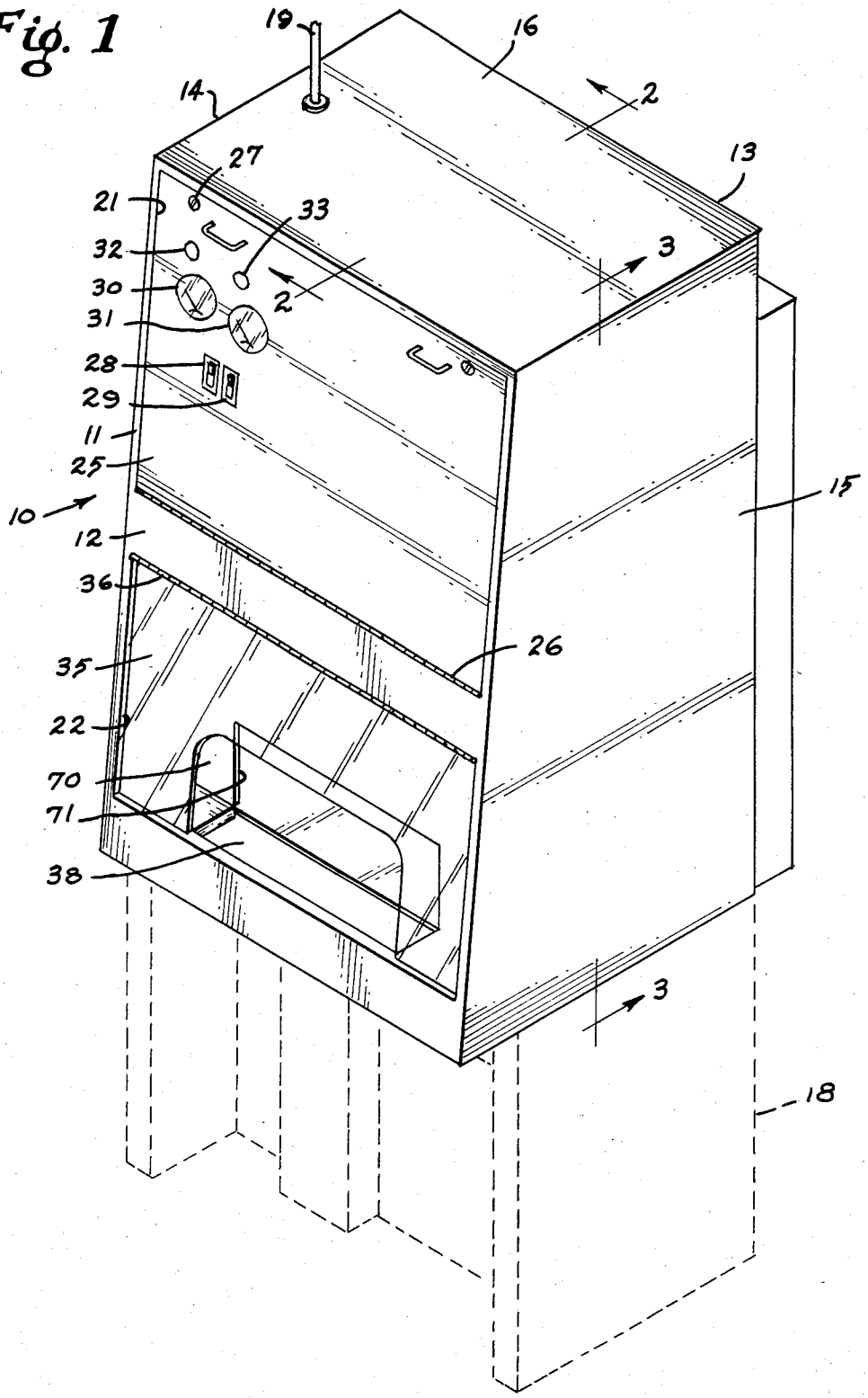
FIG. 1 is a perspective view taken from the right side of the contamination control unit of the present invention showing the unit controls and access opening.

With continued reference to the drawings, the contamination control unit 10 of the present invention is shown as including an outer housing on cabinet 11 having front and rear walls 12 and 13, side walls 14 and 15, and top and bottom walls 16 and 17. Although not specifically detailed in the drawings, the bottom wall 17 of the cabinet may be selectively removed from a closing engagement with the front, rear and side walls for a purpose which will be discussed in greater detail hereinafter. The cabinet 11 is constructed so as to be of a size to be mounted upon existing laboratory counter tops or may be provided with an optional self-supporting stand or base member 18 (as shown in dotted lines in FIG. 1).

Power for the control unit 11 is provided via a power conductor 19 which extends from the top of the cabinet. The front wall 12 of the cabinet defines two large openings 21 and 22 by way of which access may be acquired into the interior of the cabinet. The edges of the opening 21 and 22 are inwardly flanged as shown at 23 and 24, respectively. A control panel 25 is mounted within opening 21 by a elongated hinge 26. The control panel is retained in airtight engagement with the flanged edges of the opening by one or more locking means 27.

With particular reference to FIG. 1, the operating switches and gauges for the contamination control unit are mounted within the control panel 25. The controls may include interior light and blower motor switches 28 and 29, air supply and exhaust pressure gauges 30 and 31 and respective low pressure warning lights 32 and 33.

Figure 2:
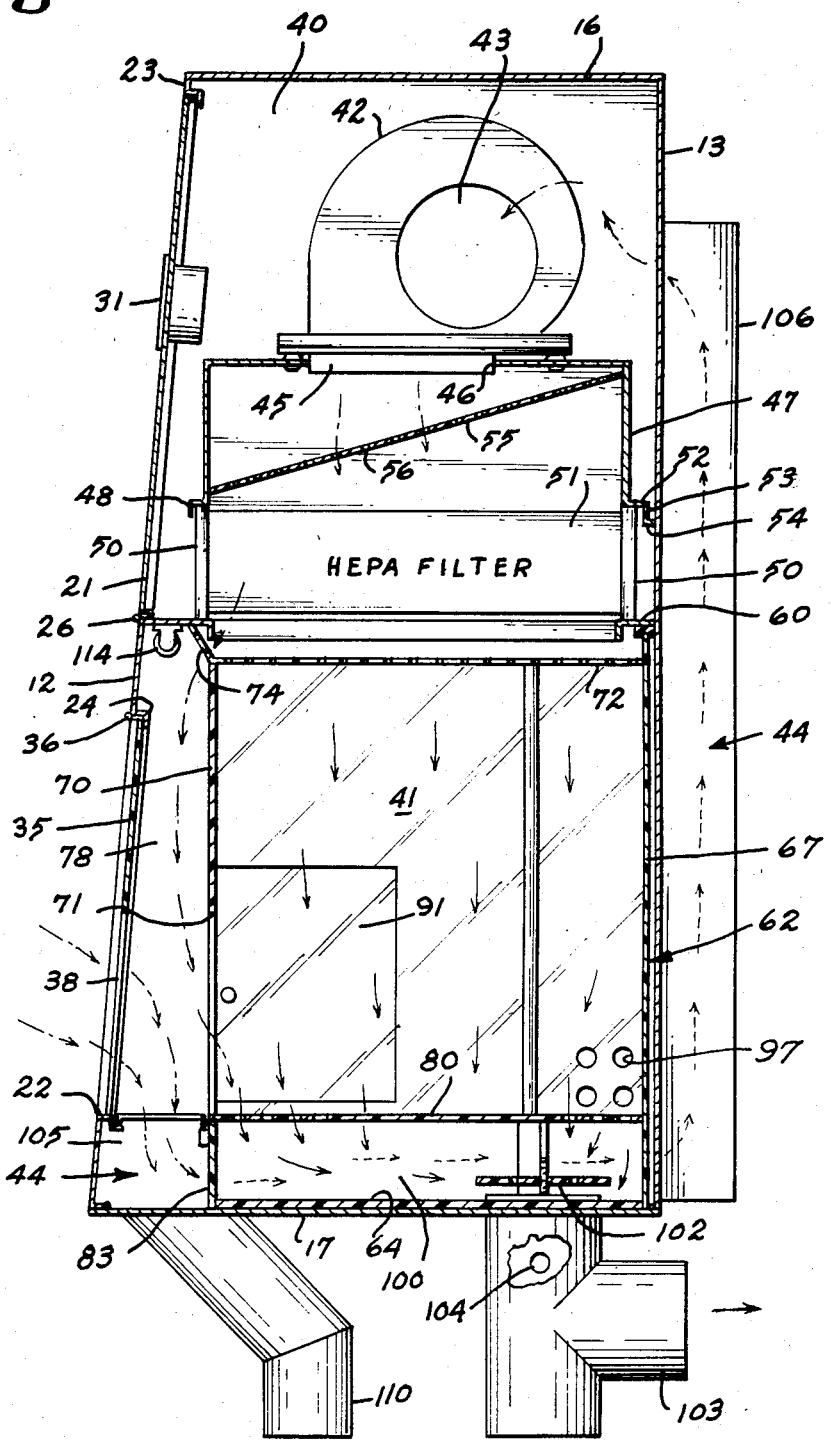
FIG. 2 is a cross-sectional view taken along lines 2—2 of FIG. 1 with arrows included to illustrate the flow pattern within the control unit.

In order to permit visual access into the work area contained within the housing, a clear plastic view screen 35 is hingedly mounted at 36 to the flanged edges 24 of the large opening 22. As shown in FIGS. 1 and 2, the view screen has an access or ambient air opening 38 through the lower portion thereof to permit continuous access into the unit. Although not shown, a selectively operable closure member could be provided to seal off the access opening 38 in the event the unit is not in use.

With regard to both the control panel 25 and the view screen 35, it should be noted that each is retained in generally airtight engagement with the front wall of the cabinet and suitable packing or gaskets may be appropriately utilized to accomplish the sealed engagement of these components.

The interior of the contamination control unit is generally divided into two primary portions. The upper portion 40 defines the ambient air treating system and the lower portion 41 defines the actual work enclosure areas. The air treating system includes an air supply centrifugal blower or fan 42 which is mounted so that the intake 43 thereof is in fluid communication via an ambient air supply passageway 44 with the access opening 38.

The air supply fan 42 is mounted with its discharge or exhaust 45 mounted through an opening 46 in a plenum chamber 47. In order to reduce noise and vibration, rubber isolators may be installed between the fan and the plenum chamber.

As shown in FIG. 2, the lower portion of the plenum chamber 47 is provided with an L-shaped flange 48 which normally rests in sealed engagement with the frame 50 of a HEPA filter element 51. In order to permit the plenum chamber 47 to be moved with respect to the HEPA filter, a section 52 of the L-shaped flange is hinged at 53 to a channel 54 mounted to the rear wall of the cabinet. A baffle member 55 is mounted within the plenum chamber and has a plurality of holes or openings 56 therein. As shown, the baffle member is disposed diagonally with the plenum chamber so as to equalize or distribute the airflow therethrough so that an even pressure is placed across the upstream surface 58 of the HEPA filter.

With continued reference to FIG. 2, the HEPA filter frame 50 is seated on bracket or frame members 60 which extend outwardly from the walls of the cabinet. The HEPA filter is in a sealed engagement between the plenum chamber and the bracket or frame members 60 so that all the air being introduced into the lower work area 41 of the cabinet must pass through the filter.

Figure 5:
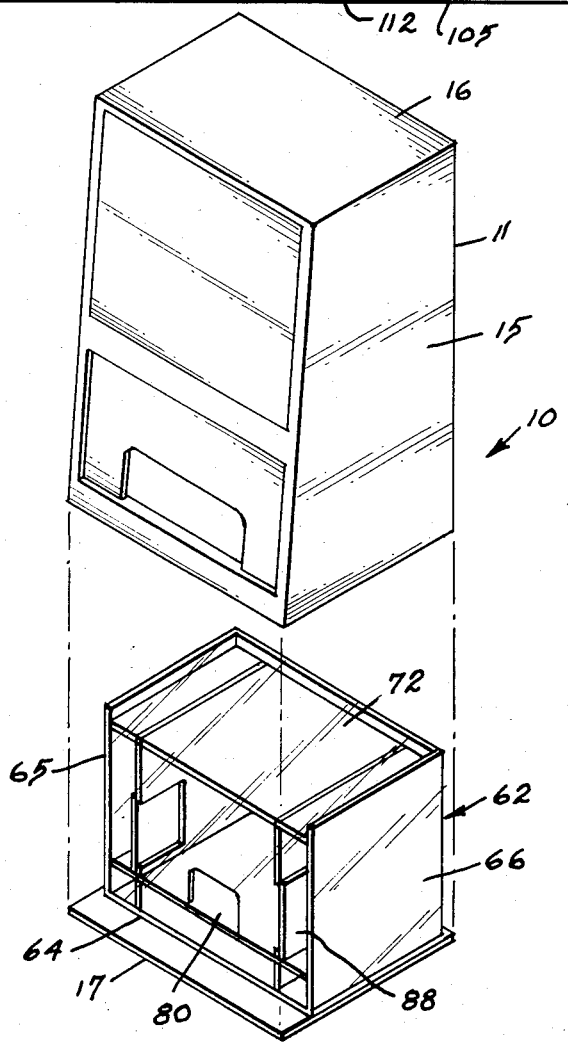
FIG. 5 is a reduced perspective illustrational view of the contamination control unit housing as it is raised from a covered relationship with the work chamber enclosure of the present invention.

The structure within the lower portion of the cabinet is generally defined by a removable insert 62 which is preferably primarily constructed of a polypropylene material. The insert defines the work space and storage area of the contamination control unit and is shown as it is separated from the cabinet in FIG. 5.

Figure 3:
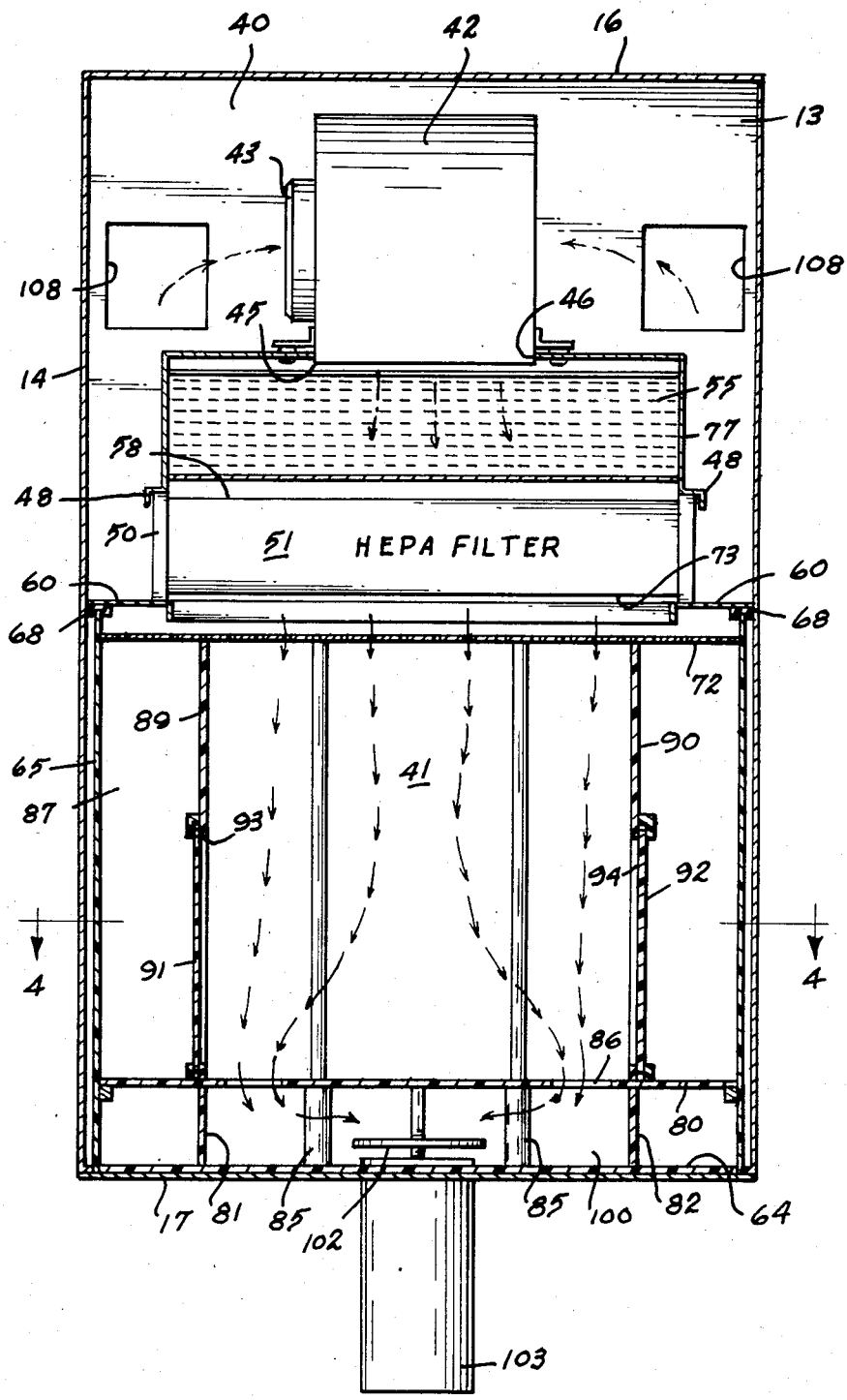
FIG. 3 is a cross-sectional view taken along lines 3—3 of FIG. 1 with arrows included to illustrate the flow patterns within the control unit.

The removable insert work compartment 62 includes a base portion 64, side panels 65 and 66 and rear panel 67. The side and rear panels are of a dimension to extend from the bottom wall of the cabinet upwardly to the frame member 60 which supports the filter 51. A foam gasket 68 is provided between the frame member 60 and the rear and side panels of the insert as shown in FIG. 3.

The front panel 70 of the insert work compartment 62 is made of a clear acrylic and has a work opening 71 therein through which access is obtained into the interior of the compartment. The front panel is spaced from the filter 51 as shown in FIG. 2. An anodized aluminum screen 72 having holes therein is positioned across the top portion of the compartment so as to be in spaced relationship to the downstream side 73 of the filter. Another anodized screen element 74 is placed between the top of the front panel 70 of the work compartment 62 and the bottom of the frame member 60 adjacent the front wall of the cabinet. Because of the sealed arrangement of the side and rear panels of the work compartment insert, air passing through the filter will be directed through the screen elements 72 and 74. The air passing through screen element 72 will be directed into the work compartment while the air passing through the front screen element 74 will enter an air space or prechamber 78 created between the acrylic front panel 70 of the insert work compartment and the view screen 35.

Figure 4:
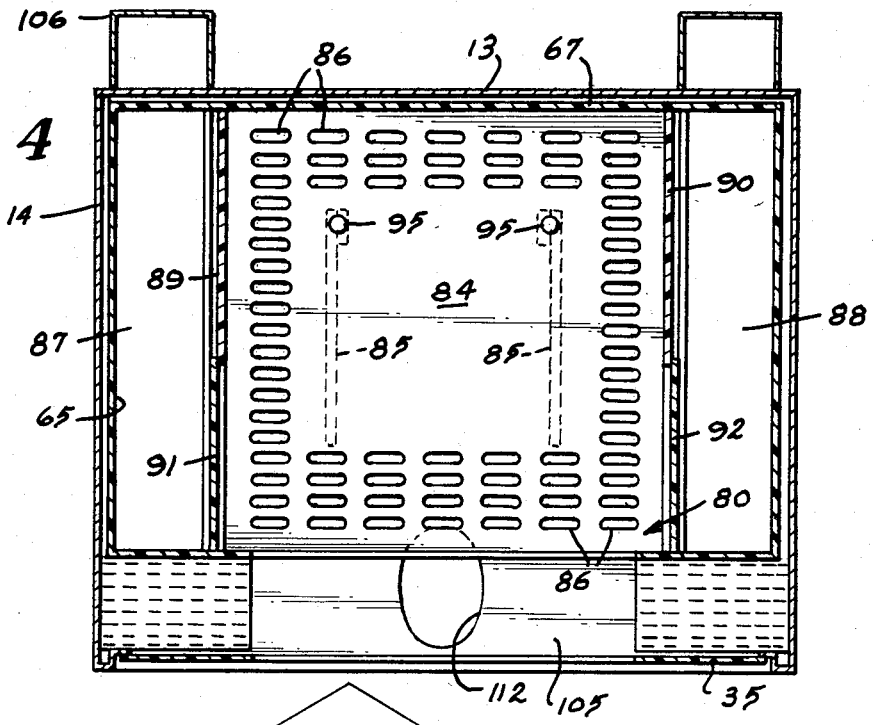
FIG. 4 is a cross-sectional view taken along lines 4—4 of FIG. 3 showing the work surface location relative to the side storage areas, work disposal chute and access opening.

Mounted in spaced relationship above the base portion 64 of the insert 62 is the floor or work surface 80, which is also constructed of a polypropylene sheet material. With particular reference to FIG. 3, the work surface is supported adjacent but spaced from the side panels 65 and 66 by a pair of wall members 81 and 82, respectively and adjacent to but spaced from the front wall of the cabinet by wall member 83. Wall member 83 extends between the walls 81 and 82 so that the area contained within the confines of the walls 81, 82, 83 and the rear wall of the cabinet is sealed from the remaining area beneath the work surface and defines an exhaust chamber 100. The center portion 84 of the work surface is supported by a pair of work deck supports 85. In order to permit airflow around and beyond the center portion of the work surface, a plurality of elongated slots or openings 86 are provided through the work surface. As shown in FIG. 4, the air discharge openings 86 are provided on the four sides of the center work portion 84.

In order to provide material storage areas 87 and 88 adjacent the working area, a pair of vertically oriented clear acrylic walls 89 and 90 are mounted so as to extend between the front and rear panels 70 and 67 and the work surface 80 and the screen element 72. Access to the storage comparments 87 and 88 is obtained through sliding acrylic doors 91 and 92 which selectively close openings 93 and 94 into the storage compartments. Airflow down into the storage compartments is vented into the work area via openings 97. With reference to FIGS. 3 and 4, if desired, a pair of openings or sockets 95 may be provided through the central work area and into the work deck supports 85. A pair of elongated ring stand rods 96 are selectively supported within the openings 95.

As previously discussed, the area beneath the center portion of the deck, enclosed by the support walls 81, 82, and 83 and rear wall of the cabinet, forms the air discharge chamber 100 for the contamination control unit. Air passing into the discharge chamber 100 is drawn through a polypropylene valve 102 through a ducting T 103 and into a main discharge exhaust system (shown by the arrow in FIG. 2) which extends to areas remote from the unit. Such ducting or exhaust systems include exhaust fans (not shown) having a power rating in excess of the blower or fan contained in the individual contamination units. In order to sense the pressure at discharge, a sensor 104 is electrically connected to the pressure gauge and warning lights mounted in the control panel of the unit. A similar pressure sensor (not shown) is mounted adjacent the blower unit 42.

As previously discussed, ambient air is introduced into the contamination control unit via an intake ducting system 44. The intake ducting system extends from the access opening 38 in the view screen 35, downwardly into a pair of covered troughs 105 created adjacent the side walls of the cabinet between the front wall of the cabinet and the wall support element 83. Each trough is covered with a screen element 107. The intake ducting system extends from the troughs 105 rearwardly through passageways created between the support wall elements 81 and 82 and side panels 65 and 66 of the insert and subsequently upwardly through exterior intake ducts 106 through openings 108 into the upper portion 40 of the cabinet.

Another feature of the contamination control unit of the present invention is the provision of a disposal chute 110 which extends downwardly from the bottom or lower portion 41 of the cabinet to a disposal container (not shown). Access to the disposal chute is through an opening 112 located at an area immediately below the chamber located between the removable insert and the view screen. In this manner, solid and liquid waste materials may be dropped into the disposal chute without having to remove the contaminated or toxic material from the controlled airflow environment within the contamination control unit.

Illumination inside the cabinet is provided by a lighting fixture 114 which is mounted to the underside of frame member 60 within the entry chamber or space 78.

The cabinet of the contamination control unit is preferably constructed of a stainless steel, and as previously mentioned, the removable work area insert is primarily constructed of a polypropylene having portions of clear acrylic plastic. The unit is desinged to present a working area that is generally table or counter top height. By way of example, the unit may be approximately five feet (5') in height from the base to the top and approximately three feet (3') in depth and slightly over three feet (3') in width. The acrylic view screen is approximately twenty-one inches (21") in height with the access opening being eight (8") to ten inches (10") in height by approximately one and one-half (1 ½') to two feet (2') in width.

From the foregoing, the inner work area and storage compartment provide approximately six (6) square feet of surface space. Generally, each storage area has one (1) square foot and the central work area 84 also provides approximately one (1) square foot in surface space. The openings 86 in the working deck 80 provide approximately three square feet of laminar airflow around the central work area.

In order to provide a class 100 air barrier or curtain across the access opening downwardly through screen 74 into the entry chamber 78 of the unit, the airflow through the access opening and into the ambient air passageway should be adjusted to a velocity of approximately 200 cu.ft./min. The airflow downwardly from the filter and past the work area will also be a class 100 downdraft discharging into the exhaust area. The centrifugal blower unit 42 should have a capacity of 280 cu.ft./min. and the central exhaust system should have an exhaust flow of at least 300 cu.ft./min.

During the operation of the contamination control unit of the present invention, the radiation or other hazardous materials will be contained within the removable insert portion of the unit. In order to prevent the escape of toxic fumes and airborne particulates to the surrounding environment, a positive flow of ambient air is created into the access opening 38 and through the ambient air passageway to the intake side of the blower 42. As the ambient air is forced by the blower into the plenum chamber, the diagonally oriented screen creates a 32% open baffle which equlizes the airflow across the filter element 51. As the ambient air passes through the filter, any particles are retained by the filter leaving a class 100 clean airflow passing through the 32% open anodized diffusion screens 72 and 74 into the work and prechamber areas.

As the clean filtered air passes through the prechamber 78, most of the air will be drawn through the discharge or exhaust openings 86. The flow of incoming ambient air together with the flow of filtered air will create a flow pattern as shown by the arrows in FIG. 2. This airflow will insure that no contamination will pass through the air curtain being established by the filtered air passing through the unit.

In the event the blower or fan 42 should fail, egress of toxic fumes or contaminates will be prevented by the continued operation of the blower units within the main exhaust ducting system. In this case, ambient air would be drawn directly through the access opening 38, through the prechamber 78, into the work area and downwardly through the exhaust openings 86.

In the event the exhaust system should fail, containment of the toxic fumes and hazardous substances will be accomplished by the units blower continuously recycling or recirculating the air within the unit. Air passing into the work area would pass into the prechamber 78, through the trough members 105 and passageways created between the support wall elements 81 and 82 and side panels 65 and 66 into the intake ducts 106 to the intake side of the blower unit. In the event strong mineral acids are being used, the only damage which may occur due to the continuous recirculation of the air within the unit would be to the filter unit, however, no contaminants should escape into the surrounding environment.

During the use of the contamination control unit, it will frequently be necessary to dispose of various solid materials including containers, tools, gloves and the like. With the present invention, such materials may be deposited through the disposal chute into an awaiting container without having to remove such material from the control unit. Additionally, should the work area become contaminated or damaged for any reason the bottom wall of the cabinet may be removed from engagement with the front, rear and side walls and thereafter the cabinet simply raised from covering or enclosing relationship with the removable work insert 62. In this manner, the entire work and storage area may be easily accessed for maintenance, repair and/or replacement.

I claim:

1. An apparatus for containing toxic fumes and hazardous substances comprising a cabinet having front, sides and rear walls and upper and lower interior portions, a first access opening in said cabinet communicating with said lower interior portion thereof, blower means mounted within said upper interior portion of said cabinet and having an inlet and a discharge, an enclosed ambient air intake passageway communicating said first access opening and said upper portion of said cabinet, a work area enclosure disposed below said blower means and within said lower interior portion of said cabinet, said work area enclosure being removably mounted as a unit within said lower interior portion of said cabinet, said work area enclosure including front, rear and side panel members which extend vertically from a work support surface member, said front panel member having a second access opening therein, a downdraft air passageway formed between said front wall of said cabinet and said front panel member of said work area enclosure, said work support surface member of said work enclosure having a central imperforate work area surrounded by a perforated portion, a filter means mounted between said discharge of said blower means and said work area enclosures so that air passing into said work area enclosure and said downdraft passageway passes first through said filter means, and a plenum chamber means mounted between said discharge of said blower means and said filter means, said plenum chamber means including a diffusion screen means for equalizing the airflow, across and into said filter means, an exhaust chamber beneath said work support surface member and substantially enclosed with respect to said ambient air intake passageway an outlet means for discharging air from said exhaust chamber.

2. The apparatus of claim 1 in which said perforated portion of said work support surface member is at least three times the area of said central imperforate work area.

3. The apparatus of claim 1 including disposal chute means disposed within said lower interior portion of said cabinet and having an opening generally below said first access opening and in vertical alignment with said downdraft air passageway.

4. An apparatus for containing toxic fumes and hazardous substances and which communicates with a remote air discharge system having exhaust elements for exhausting air at a first rate from the apparatus comprising a cabinet having front, sides and rear walls and upper and lower interior portions, said front wall including a viewing panel, a first access opening in said viewing panel communicating with said lower interior portion of said cabinet, blower means mounted within said upper interior portion of said cabinet and having an inlet and a discharge, said blower means generally creating an airflow of a second rate which is less than the first rate created by the exhaust elements, an enclosed ambient air intake passageway communicating said first access opening and said upper portion of said cabinet, a filter means mounted between said discharge of said blower means and said lower interior portion of said cabinet for receiving air being discharged by said blower means, a work area enclosure disposed below said filter means and within said lower interior portion of said cabinet, said work area enclosure being removably mounted as a unit with said cabinet, said work area enclosure including a work surface and a first vertical panel member mounted between said work surface and said first access opening forming a downdraft space therebetween, a second access opening through said first vertical panel member and general aligned with said first access opening, said work area enclosure also including a pair of spaced first side panel members having front and rear portions, a rear panel member extending between and joining the rear portions of said first panel member, said first vertical panel member extending between and joining said front portions of said side panel members, said side panel members and said rear panel member extending upwardly to an air seal adjacent said filter means, means for directing a first portion of air passing from said filter means into said downdraft space and a second portion of the air passing from said filter means directly into said work area enclosure, a first air diffusion means carried by said work enclosure so as to be in spaced relationship between said filter element and said work surface so that said second portion of said air passing from said filter means passes through said first diffusion means toward said work surface, a second air diffusion means carried by said work area enclosure so as to be in spaced relationship between said filter element and said downdraft space so that said first portion of said air passing from said filter means passes through said second air diffusion means, said work surface having an imperforate central portion which is surrounded by an outer portion having a plurality of discharge openings therethrough to permit airflow therethrough, said outer portion of said work surface being at least approximately three times the area of said central portion thereof, an air discharge chamber below said work surface and in generally closed relationship with respect to said air intake passageway, and exhaust valve means for connecting said air discharge chamber to the remote air discharge system so that air passing through said discharge openings and into said air discharge chamber from said work area enclosure and said downdraft space is positively exhausted therefrom.

5. The apparatus of claim 4 in which said blower means generally creates an airflow into and through said first access opening of at least 200 cubic feet per minute and the remote exhaust elements exhaust air at a rate generally greater than the intake rate created by said blower means.

* * * * *